US011250661B2

(12) United States Patent
Goldstein et al.

(10) Patent No.: US 11,250,661 B2
(45) **Date of Patent: *Feb. 15, 2022**

(54) GAMING MACHINE WITH INTEGRAL FEATURES FOR EASE OF ASSEMBLY

(71) Applicant: SG Gaming, Inc., Las Vegas, NV (US)

(72) Inventors: Brian Goldstein, Las Vegas, NV (US); Michael David Owens, Reno, NV (US); Abraham D. Usi, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 342 days.

This patent is subject to a terminal disclaimer.

(21) Appl. No.: 16/688,244

(22) Filed: Nov. 19, 2019

(65) Prior Publication Data

US 2020/0098219 A1 Mar. 26, 2020

Related U.S. Application Data

(63) Continuation of application No. 16/004,019, filed on Jun. 8, 2018, now Pat. No. 10,573,118.

(60) Provisional application No. 62/529,356, filed on Jul. 6, 2017.

(51) Int. Cl.
*G07F 17/32* (2006.01)

(52) U.S. Cl.
CPC ..... *G07F 17/3211* (2013.01); *G07F 17/3216* (2013.01)

(58) Field of Classification Search
CPC ..... G07F 17/3211; G07F 17/3216; G07F 17/3218
See application file for complete search history.

(56) References Cited

U.S. PATENT DOCUMENTS

| | | | | |
|---|---|---|---|---|
| 5,876,285 | A | 3/1999 | Salour et al. | |
| 5,951,131 | A | 9/1999 | Stefan | |
| 8,454,444 | B2 | 6/2013 | Cole | |
| 9,640,020 | B2 | 5/2017 | Sum | |
| 9,697,679 | B2 | 7/2017 | Ho et al. | |
| 2007/0238531 | A1 | 10/2007 | Taxon | |
| 2008/0113818 | A1 | 5/2008 | Beadell et al. | |
| 2009/0280911 | A1 | 11/2009 | Tsao | |
| 2011/0136573 | A1 | 6/2011 | Mccomb et al. | |
| 2013/0023346 | A1 | 1/2013 | Greenberg et al. | |
| 2014/0087868 | A1 | 3/2014 | Rosander et al. | |
| 2016/0335836 | A1 | 11/2016 | Castro et al. | |
| 2016/0343204 | A1 | 11/2016 | Maher et al. | |
| 2018/0190068 | A1* | 7/2018 | Priddy | G07F 17/3216 |

* cited by examiner

*Primary Examiner* — Robert T Clarke, Jr.

(57) ABSTRACT

A gaming machine includes a monitor subassembly, a game control core, and a structural frame that may be manufactured and shipped separately to a final destination and assembled on-site. The gaming machine components include integral features and components that facilitate a novel and efficient assembly process.

20 Claims, 7 Drawing Sheets

GAMING MACHINE WITH INTEGRAL FEATURES FOR EASE OF ASSEMBLY

CROSS-REFERENCE TO RELATED APPLICATIONS

This application claims the benefit of U.S. patent application Ser. No. 16/004,019, filed on Jun. 8, 2018, which claims the benefit of U.S. Provisional Patent Application No. 62/529,356, filed on Jul. 6, 2017, both of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2017, Bally Gaming, Inc.

FIELD OF THE INVENTION

The present invention relates generally to gaming systems, apparatus, and methods and, more particularly, to the design and assembly of gaming machine components that have integral features that facilitate assembly of the components into a fully functional gaming machine.

BACKGROUND OF THE INVENTION

The gaming industry is highly regulated and requires strict adherence to various policies affecting authentication, operation, and security of electronic components, computer code and data stored in memory devices, and network communications. Some regulations involve authenticating gaming programs at the time of manufacture, and verifying program authenticity prior to activating the gaming machine on a casino floor or other gaming venue.

Meeting these regulatory requirements may be abetted by reducing the number of components/assemblies that are shipped separately and may be susceptible to tampering. At the same time, game machine manufacturers continually seek to improve manufacturing and assembly methods in order to facilitate efficiencies throughout the manufacturing process. It is known and understood that there is a need for gaming machines which provide state-of-the-art visual, audio, and gaming experiences yet can be produced in quantity with high quality and can be shipped, assembled, and installed utilizing simple tools, minimal manpower, and typical skills.

As the industry matures, the creativity and ingenuity required to improve such operation, design, assembly and delivery of gaming apparatus grows accordingly.

SUMMARY OF THE INVENTION

According to one aspect of the present invention, a gaming machine comprises a monitor subassembly including an electronic display device, a retractable rolling support system, and a lift connection, the monitor subassembly having a free-standing position resting on the rolling support system. The gaming machine further comprises a game control core including one or more electronic input devices.

The gaming machine further comprises a structural frame including an integral lift mechanism, a retractor element, and a core cavity.

The lift mechanism is configured to connect to the lift connection of the monitor subassembly in the free-standing position and to lift the monitor subassembly from the free-standing position to a mounted position supported by the structural frame. The retractor element is configured to interact with the retractable rolling support system and cause the retractable rolling support system to retract when the monitor subassembly transitions from the free-standing position to the mounted position. And the core cavity is configured to accept at least part of the game control core.

According to another aspect of the invention, a method of assembling a gaming machine comprises providing a monitor subassembly including an electronic display device, a retractable rolling support system, and a lift connection, the monitor subassembly having a free-standing position resting on the retractable rolling support system. The method further includes providing a game control core including one or more electronic input devices, and providing a structural frame including an integral lift mechanism, a retractor element, and a core cavity.

With the monitor subassembly in the free-standing position proximal to the structural frame, the method further comprises connecting the lift mechanism to the lift connection and causing the lift mechanism to lift the monitor subassembly from the free-standing position to a mounted position supported by the structural frame. The method further comprises engaging the retractable rolling support system with the retractor element to automatically cause the retractable rolling support system to retract when the monitor subassembly transitions from the free-standing position to the mounted position. The method still further comprises inserting the at least part of the game control core into the core cavity.

According to still another aspect of the invention, a gaming machine comprises a monitor subassembly including an electronic display device, a retractable rolling support system, and a lift connection, the monitor subassembly having a free-standing position resting on the rolling support system. The gaming machine further comprises a game control core including a player input deck with one or more electronic input devices, and game-logic circuitry configured to conduct a casino wagering game and to direct the electronic display device to display images associated with the casino wagering game. The gaming machine still further comprises a structural frame including an integral lift mechanism and at least one retractor element.

The lift mechanism is configured to connect to the lift connection of the monitor subassembly in the free-standing position and to lift the monitor subassembly from the free-standing position to the mounted position supported by the structural frame. The at least one retractor element is configured to interact with the retractable rolling support system and to automatically cause the retractable rolling support system to retract when the monitor subassembly transitions from the free-standing position to the mounted position. The assembled gaming machine including the structural frame, the monitor subassembly in the mounted position, and the game control core, is configured to receive an input from a player effecting initiation and play of the casino wagering game, display game images representing a randomly generated outcome on the electronic display device, and award the player for a winning outcome.

Additional aspects of the invention will be apparent to those of ordinary skill in the art in view of the detailed description of various embodiments, which is made with reference to the drawings, a brief description of which is provided below.

Figure 1:
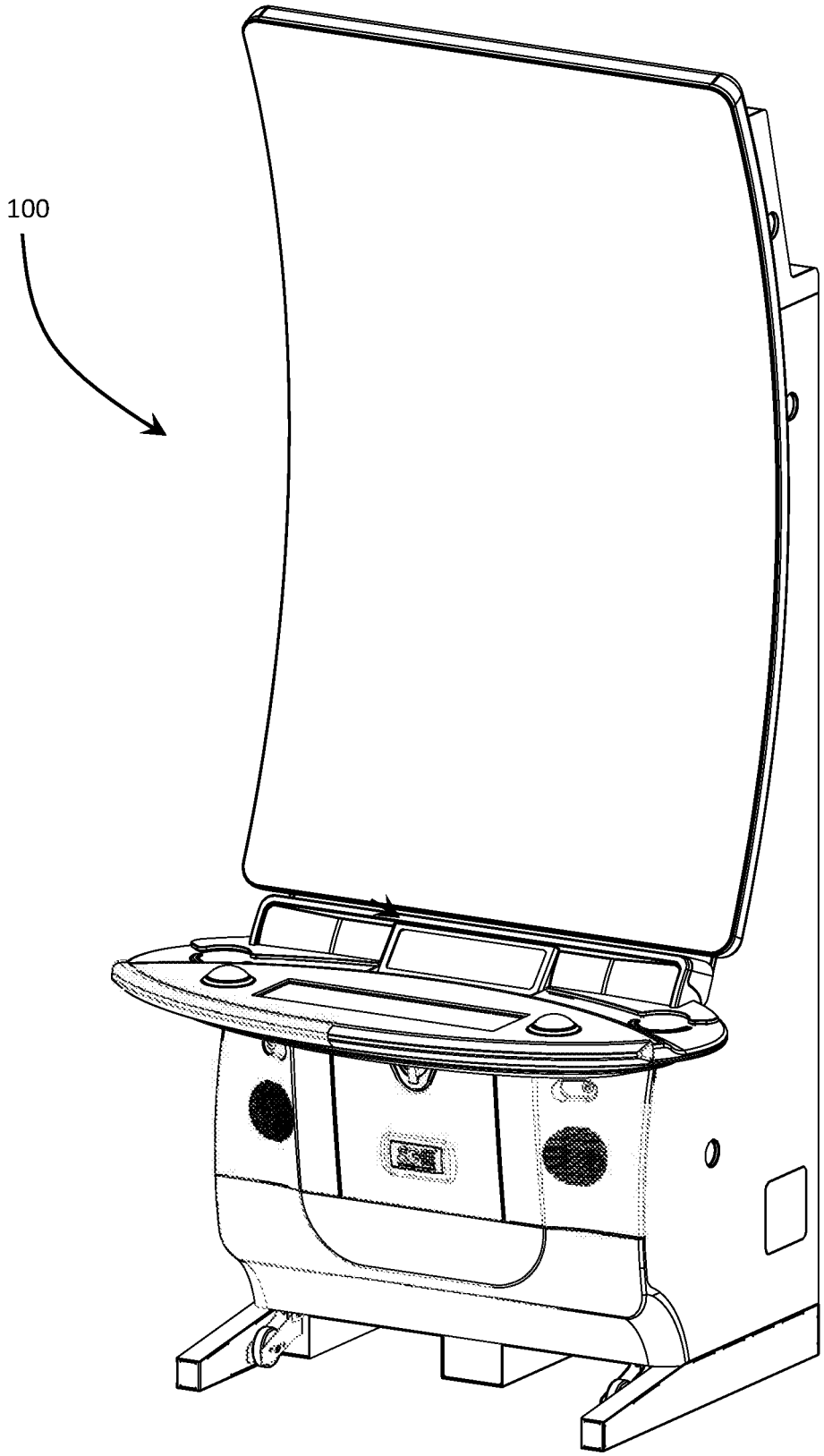
FIG. 1 is a perspective view of a gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill.

Referring to FIG. 1, there is shown a gaming machine 100 similar to those operated in gaming establishments, such as casinos. Such gaming machines typically include various components that function together to implement the presentation of a game that may include visual game images, audio effects including music, voices, and sound effects, and sometimes more exotic outputs such as vibrations, tactile effects, lighting effects, etc. The gaming machine 100 is an electronic gaming terminal configured to play a video casino game, such as slots, keno, poker, blackjack, roulette, craps, etc. The game presented on the gaming machine 100 may be of various types and combinations of types such that may lend themselves to presentation via the gaming machine. The gaming machine 100 may be primarily dedicated for use in playing wagering games, or may include non-dedicated devices, such as mobile phones, personal digital assistants, personal computers, etc. Those having skill in the gaming arts will readily recognize that there are various configurations, modifications, and alternate embodiments of the gaming machine 100 that are considered to be part of the spirit and basic aspects of the invention. For example, but not limiting the scope of different embodiments, the gaming machine may include multiple display devices, including planar display devices, arranged in various configurations.

As may be required to present a particular game, a gaming machine 100 may comprise various input devices, output devices, input/output devices, internal electronic/electromechanical components, and wiring. For example, input devices may be provided to enable a player to initiate, select, direct, and/or terminate a game on the gaming machine. Non-limiting example of input devices include mechanical/electromechanical buttons, levers, gesture-detecting devices, and various wired and wireless handheld devices (e.g., wand, hand controller, fishing rod). An input device may be configured to receive currency, a printed ticket, or a credit card used to establish a credit balance on the gaming machine. An output device may be an electronic display device for providing a visual display of images etc. related to the game. An electronic display device may include a touchscreen input device configured to receive touch inputs from a player. Additionally and alternatively, an output device may be an audio speaker or other device suitable to emit sounds related to the game. An input/output device may include a ticket reader/writer that can accept and deliver printed tickets bearing indicia indicative of monetary value. Other peripheral and integral devices may be a part of, or connected to, the gaming machine, such as player accessible ports (e.g., audio output jack for headphones, video headset jack, USB port), secondary or tertiary display devices, wireless transmitters/receivers, etc. It should be understood that numerous other peripheral devices and other elements exist and are readily utilizable in any number of combinations to create various forms of a gaming machine in accord with the present concepts.

Figure 2:
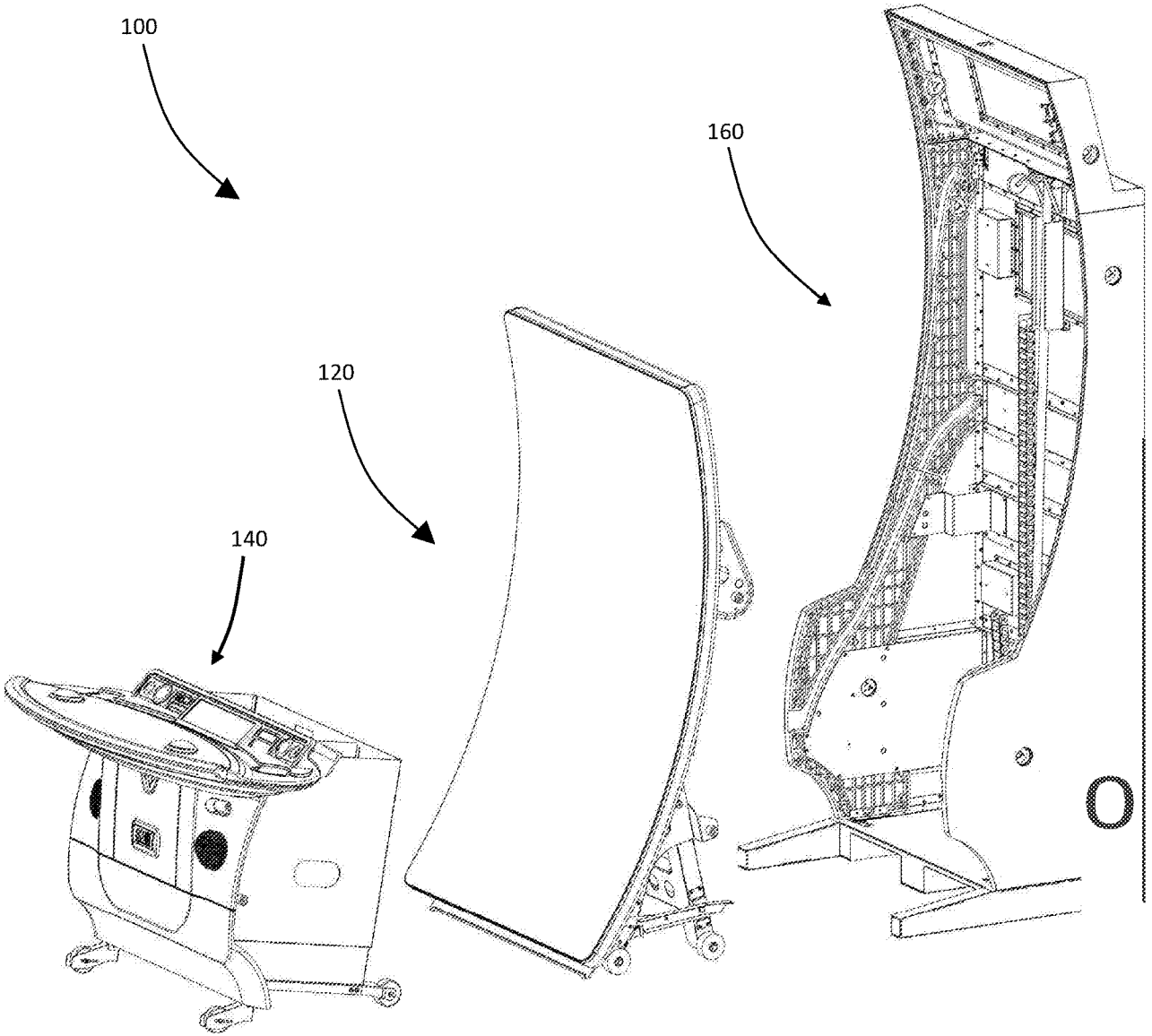
FIG. 2 is a perspective view of gaming machine components prior to assembly according to an embodiment of the present invention.

FIG. 2 shows an embodiment of the gaming machine 100 illustrating separate subassemblies which may be constructed according to the aspects of the invention to provide a fully functional gaming machine operable to conduct a wagering game.

The gaming machine 100 includes a monitor subassembly 120 with primary display device disposed in a forward-facing position (i.e., facing a player position), and supported by a structural frame 160. The primary display device of the gaming machine 100 is configured in a concave curvature with the active display surface positioned along the concavity. Various primary display device configurations may be utilized, including, but not limited to, a flat, planar display device, a display device with a convex curvature, a display device with an irregular, asymmetric, or arbitrary curvilinear configuration, and combinations thereof. Additionally, a monitor subassembly 120 may comprise multiple electronic display devices that form a primary display assembly. These and other configurations are considered to be in keeping with the basic aspects and intent of the invention.

The gaming machine 100 further includes a game control core 140 that may comprise various input devices, output devices, input/output devices, game-logic circuitry, memory devices, and electronic communication means for connecting to and controlling the electronic display device(s) of the monitor subassembly 120. Additionally, the game control core 140 may include means for communicating with external systems on a network.

In an embodiment, the input devices, output devices, and input/output devices are disposed on, and securely coupled to, the game control core 140. By way of example, the output devices may include a secondary display, and one or more audio speakers. The secondary display may be a mechanical-reel display device, a video display device, or a combination thereof in which a transmissive video display is disposed in front of the mechanical-reel display to portray a video image superimposed upon the mechanical-reel display. The display devices variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 100. The gaming machine 100 may include a touch screen(s) mounted proximal to the primary or secondary displays, buttons on a button panel, a bill/ticket acceptor, a card reader/writer, a ticket dispenser, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

Player input devices, such as the touch screen, buttons, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 100 may include one or more value input/payment devices and value output/payout devices. In order to deposit cash or credits onto the gaming machine 100, the value input devices are configured to detect a physical item associated with a monetary value that establishes a credit balance for use with the wagering game. The physical item may, for example, be currency bills, coins, tickets, vouchers, coupons, cards, and/or computer-readable storage mediums. The deposited cash or credits are used to fund wagers placed on the wagering game played via the gaming machine 100. Examples of value input devices include, but are not limited to, a coin acceptor, the bill/ticket acceptor, the card reader/writer, a wireless communication interface for reading cash or credit data from a nearby mobile device, and a network interface for withdrawing cash or credits from a remote account via an electronic funds transfer. In response to a cashout input that initiates a payout from the gaming machine 100, the value output devices are used to dispense cash or credits from the gaming machine 100. The credits may be exchanged for cash at, for example, a cashier or redemption station. Examples of value output devices include, but are not limited to, a coin hopper for dispensing coins or tokens, a bill dispenser, the card reader/writer, the ticket dispenser for printing tickets redeemable for cash or credits, a wireless communication interface for transmitting cash or credit data to a nearby mobile device, and a network interface for depositing cash or credits to a remote account via an electronic funds transfer.

In the embodiment shown in FIG. 2, both the monitor subassembly 120 and the game control core 140 are free-standing and easily movable via roller support systems. This mobility enables the subassemblies to be transported to their final location separately and, in the case of the monitor subassembly 120 and the game control core 140, without the need for secondary material handling devices (e.g., hand dolly) The structural frame 160 is free-standing and provides a strong and stable platform to which the monitor subassembly 120 and game control core 140 may be mounted and secured.

Monitor Subassembly

Figure 3:
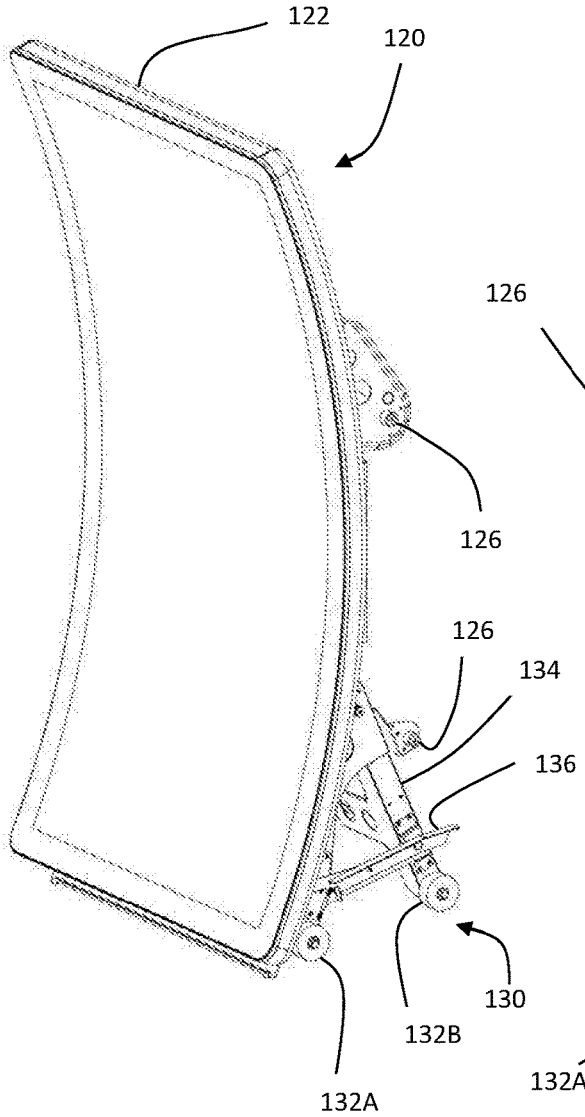
FIG. 3 is perspective view of a monitor subassembly according to an embodiment of the present invention.
Figure 4:
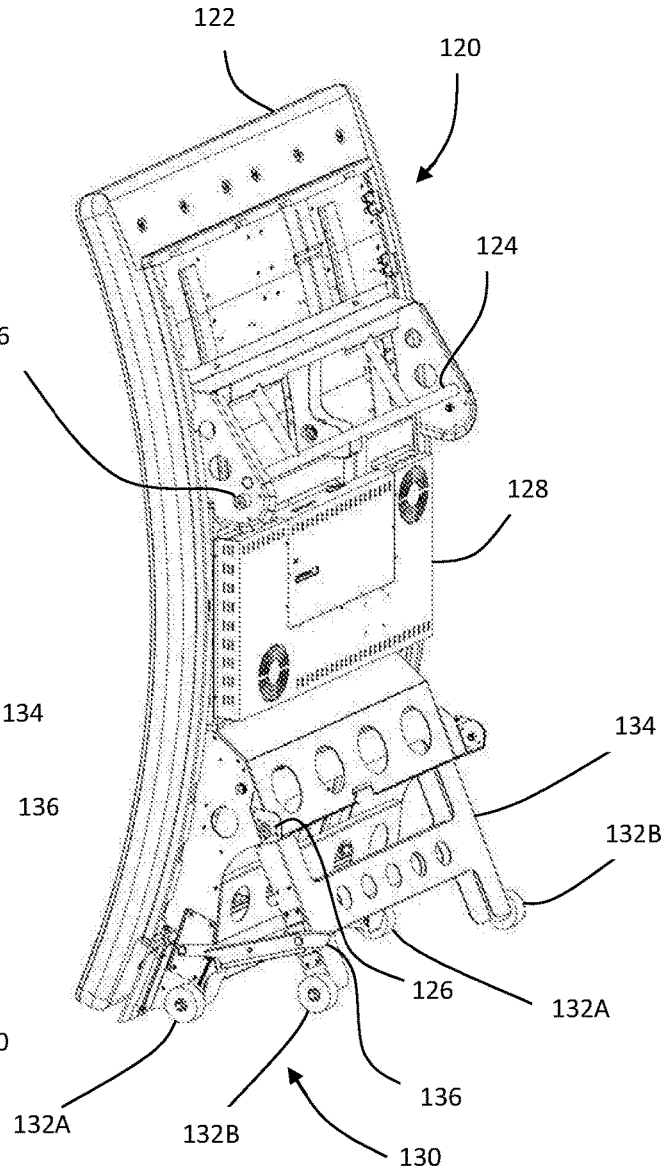
FIG. 4 is another perspective view of the monitor subassembly of FIG. 3.

FIGS. 3 and 4 are perspective views of an embodiment of a monitor subassembly 120. The same reference numbers are used in both FIGS. 3 and 4 to indicate the same elements. The monitor subassembly 120 may be configured to include components to operate an electronic display device(s) included in its construction. The monitor subassembly 120 includes a primary display device 122, such as a LED, LCD, OLED, or other type of display device. The display device 122 is a portrait-oriented concave display screen. Other embodiments may include a planar screen, a convex screen, or a combination thereof, and may have alternative orientations. Also, an embodiment may include more than one display device. In the embodiment shown in FIGS. 3 and 4, the monitor subassembly 120 further includes an electronic enclosure 128 that houses various electronic components configured to operate the display device 122.

In an embodiment, the monitor subassembly 120 includes a retractable rolling support system 130. The rolling support system 130 is configured to have an extended position (as shown in FIGS. 3 and 4) which may support the monitor subassembly 120 in a free-standing position that is stable and enables the subassembly to be moved via the rollers 132A, 132B. One or more of the rollers 132A, 132B may be lockable (i.e., put into a non-rolling mode) to further facilitate safety and stability in the free-standing position. As used here and throughout, "roller" is intended to include castors, wheels, rollers, and various other rolling elements as are known in the art of motion-enabling machines and components.

The monitor subassembly 120 includes additional structural elements utilized in the assembly process of the gaming machine 100. For example, one or more monitor projections, such as the guide bearings 126, may be provided for engagement with features of the structural frame 160 to steer the monitor subassembly 120 into a mounted position on the structural frame 160. "Bearings," as used here and throughout, are intended to include rotating elements, static bushings, and stationary pins. Also, the monitor subassembly 120 may include a lift connection 124 to facilitate lifting onto the structural frame 160 during assembly. In an embodiment, the lift connection 124 comprises a cross bar that may be further utilized as a handhold while transporting the monitor subassembly 120 on the rolling support system 130.

The rolling support system 130 includes, in one embodiment, fixed rollers 132A disposed proximal to the back side of the display device 122. The rolling support system 130 further includes a pivoting frame 134 configured to retract against the back side of the monitor subassembly 120 when the monitor subassembly 120 is mounted on the structural frame 160. The pivoting frame 134 provides mounting for retractable rollers 132B. The pivoting frame 134 includes a lever 136 that can be engaged to cause the pivoting frame 134 to retract. In addition to retracting to facilitate mounting on the structural frame 160, the pivoting frame 134 can be retracted manually via the lever 136. With the pivoting frame 134 retracted, the monitor subassembly 120 may be transported by an operator via the cross bar (i.e., the lift connection) and the fixed rollers 132A in the fashion of a two-wheel dolly. From the retracted position, the rolling support system may be configured to re-extend automatically, for example, the pivoting frame 134 may be biased to move to the extended position. In such an embodiment, the pivoting frame 134 may require a sustained force to remain in the retracted position. The pivoting frame 134 and the lever 136 are exemplary elements of an embodiment of the retractable rolling support system and may be altered, modified, and/or eliminated, singly or in combination, in another embodiment that uses another type of retractable mechanism. Such alteration/elimination is considered to be within the spirit and general aspect of the invention.

Game Control Core

Figure 5:
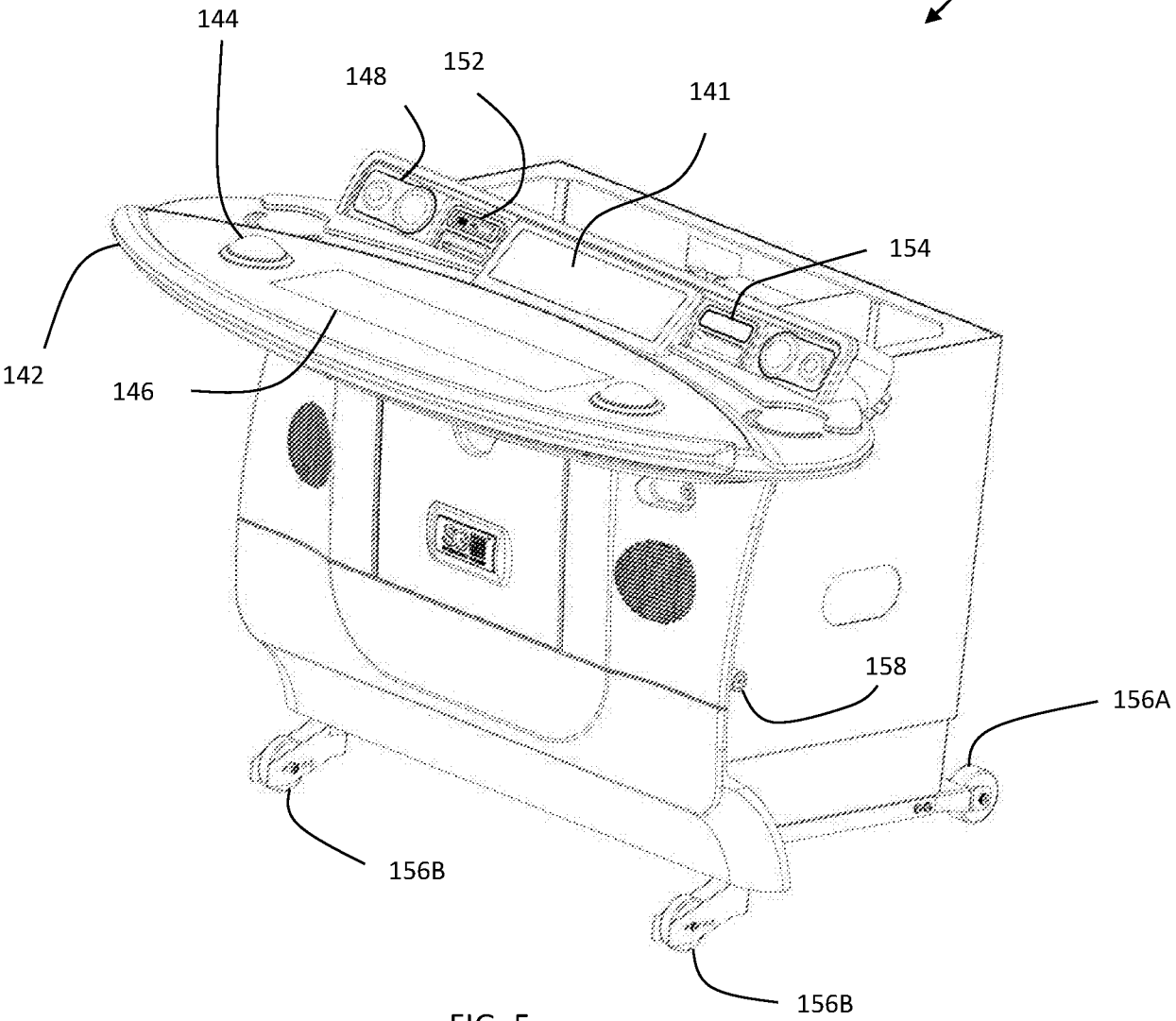
FIG. 5 is a perspective view of a game control core according to an embodiment of the present invention.

An embodiment of a game control core 140 is illustrated in FIG. 5. A game control core may be configured to provide all the electronic components needed to conduct a wagering game, including but not limited to game-logic circuitry, memory storage devices, distributed processors, and additional peripheral devices such as player input devices (e.g., mechanical buttons 144, touchscreen buttons 146), value input devices (e.g., bill and coin acceptors, ticket reader, card reader), audio output devices, and even video output devices (excepting the electronic display device 122). In an embodiment, the game control core 140 requires only power and electronic connection to a suitable display device to provide a fully functional presentation of a wagering game.

The game control core 140 may include value input devices such as a bill acceptor 154 configured to receive currency for establishing a credit balance. Additionally or alternatively, a value input device may comprise a ticket reader, a credit card reader, and various other suitable devices.

Further, the game control core 140 may include an output device such as a ticket printer 152 configured to print a ticket bearing indicia representing monetary value. In an embodiment, the game control core 140 may include a secondary display device 141 configured to display game related imagery, promotional video, and other non-gaming content. The game control core 140 may include audio output devices such as speakers 148 to present gaming and non-gaming audio content.

The game control core 140 comprises a player input deck 142 that generally defines a player position facing the display device 122 and may comprise locations for input devices, output devices, value input devices, and a focus for audio presentation. The player input deck 142 is substantially oval and horizontal with a slanted front panel that enhances player accessibility to some components. In an embodiment, the player input deck 142 may take various forms and configurations.

Inside the game control core 140 (not visible in FIG. 5), game-logic circuitry including but not limited to one or more processors, one or more memory storage devices, wired and/or wireless communication interfaces, wired and/or wireless communication devices, I/O busses, video processing cards, etc. may be provided as needed for wagering game execution and presentation.

In the embodiment shown in FIG. 5, the game control core 140 is configured with many, if not all, of the electronic components (except the display device 122) and peripheral devices required of a gaming machine. This configuration minimizes the individual connections and steps in the assembly process. The game control core 140 provides a substantially self-contained electronics control package that needs only to be inserted into the structural frame 160 and connected to the display device 122 to be a fully functional gaming machine receiving wagers, initiating play of a wagering game, and awarding a player for winning outcomes.

Further facilitating easy assembly, the game control core 140 is movable by means of integral rollers. This includes rollers rear 156A and front rollers 156B, which are positioned so that, when supported by the rollers, the game control core 140 is canted towards the rear rollers 156A. As will be explained later, this canted orientation facilitates installation of the game control core 140 into the structural frame 160. In another embodiment of the game control core, the canted orientation may be different or eliminated altogether in favor of a level orientation. Similarly, a different embodiment may include various numbers of rollers and various roller types. In an embodiment, the game control core 140 may include one or more core pins 158 that engage respective features of the structural frame to facilitate positioning the game control core with respect to the structural frame.

Structural Frame

The gaming machine 100 includes a structural frame 160. The structural frame 160 is configured to support and contain the monitor subassembly 120 and the game control core 140 in a suitable relative disposition to present a wagering game to a player. The structural frame 160 may include various features that interact with and/or accommodate respective mating features of particular embodiments of the monitor subassembly 120 and the game control core 140. Any or all of these features may be modified/repositioned/eliminated responsive to requirements of the respective embodiments yet still reflect the basic aspect and intent of the invention.

Figure 6:
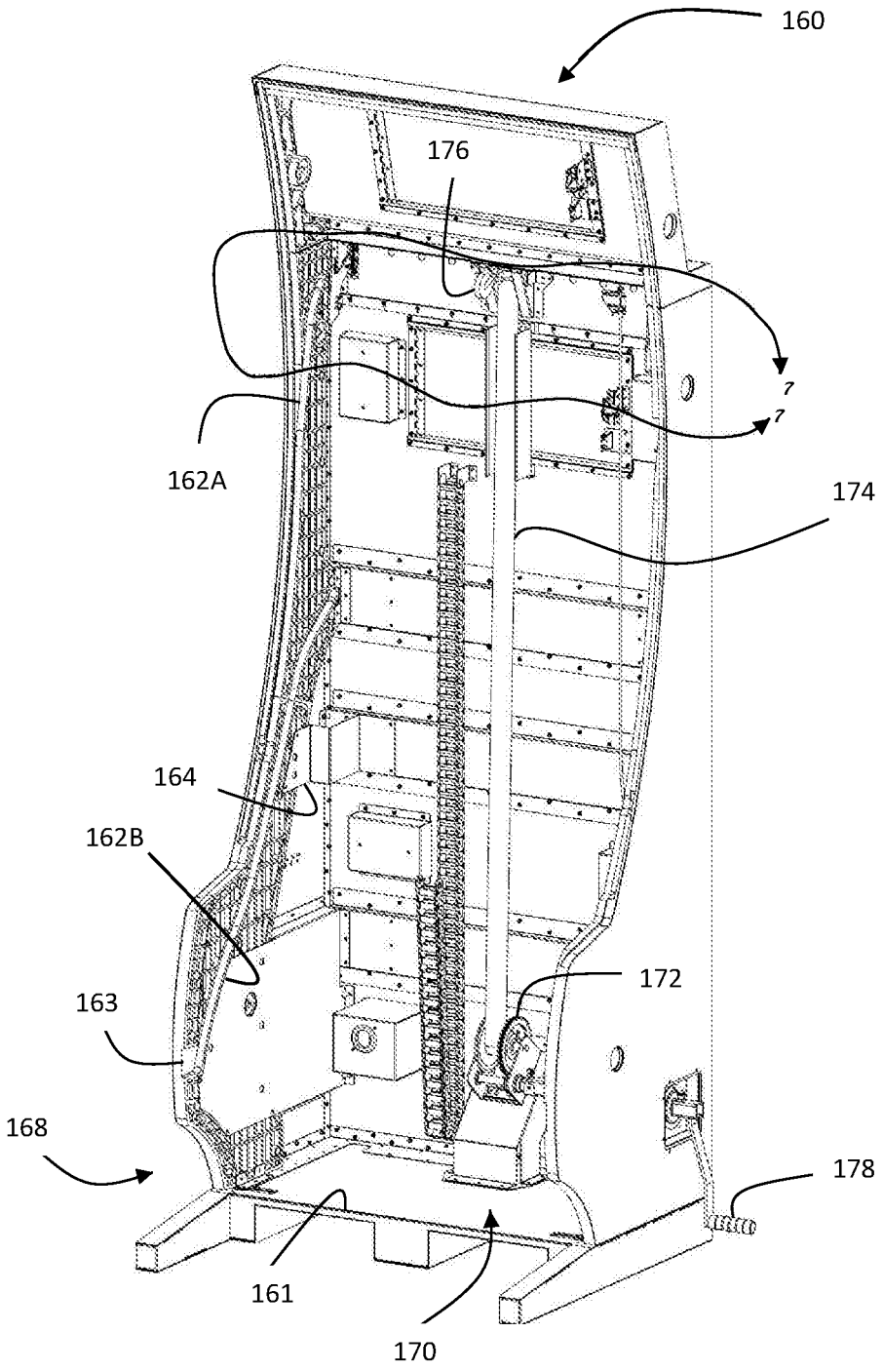
FIG. 6 is a perspective view of a structural frame according to an embodiment of the present invention.

The structural frame 160 illustrated in FIG. 6 includes an integral lift mechanism 170 configured to connect to the monitor subassembly 120 and to lift the monitor subassembly to a mounted position on the structural frame 160. In an embodiment, the lift mechanism 170 comprises a winch 172 and an elongate flexible element such as a belt 174. The winch 172 is powered via a manual crank 178. The manual crank 178 may be removable when not in use. The lift mechanism 170 further includes a coupling 176 for attaching to a feature of the monitor subassembly 120 such as the lift connection 124. In this way, the winch 172 can lift the monitor subassembly 120 by retracting the belt 174. In an embodiment, the lift mechanism may comprise an electric winch. Alternatively, a lift mechanism may be a pneumatic, hydraulic, or mechanical ratchet device, or various other lift mechanisms or combinations thereof. A lift mechanism may be manually controlled, as by the crank 178, or electronically controlled by switch, remote control, or executable code.

Figure 7:
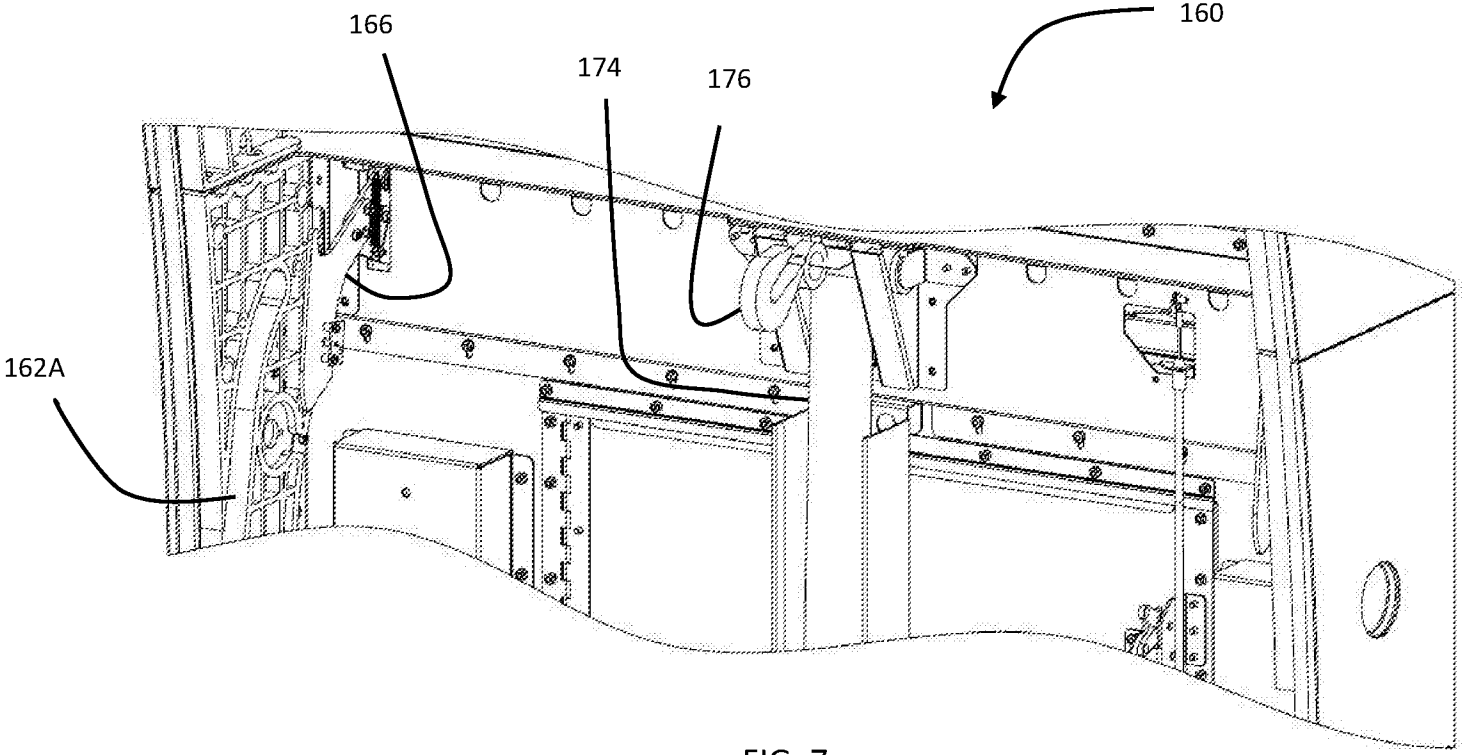
FIG. 7 is a detail view bounded by the line 7-7 of FIG. 6.

As shown in the detail view of FIG. 7, the structural frame 160 may include a mounting latch such as one or more latch hooks 166 configured to automatically capture a feature of the monitor subassembly 120 and to fix the monitor subassembly 120 in the mounted position on the structural frame 160. In an embodiment, the structural frame 160 may include a pair of latch hooks 166 (one not visible) and the latch hooks may comprise various configurations that facilitate automatic capture and reliable support and still be true to the basic aspect and intent of the invention. Latch hook 166 is biased (at least by gravity) towards a position which enables automatic engagement of the lift connection 124 of the monitor subassembly 120. The latch hook 166 may comprise a biasing element such as a spring, resilient element, air spring, etc. In a different embodiment, the latch hook 166 may be configured to capture a different feature of the monitor subassembly 120. Also shown in FIG. 7 is the lift coupling 176.

Referring again to FIG. 6, in an embodiment, the structural frame 160 includes guide features that interact with corresponding features of the monitor subassembly 120 to guide the monitor subassembly into the designated mounted position. For example, an upper guide channel 162A and a lower guide channel 162B are configured to engage the upper guide bearing 126A and the lower guide bearing 126B, respectively, of the monitor subassembly 120 in the free-standing position to ensure that the lift mechanism elevates the monitor subassembly 120 along a path that terminates at the designated mounted position.

The structural frame 160 comprises a core cavity 168 configured to receive at least part of the game control core 140. The core cavity 168 is part of lower portion of the structural frame 160 and inserting the game control core 140 in the core cavity 168 results in positioning the input deck 142 below and proximal to the display device 122 as is suitable for a player position facing the display device 122. The core cavity 168 includes a shelf 161 configured to support the rear rollers 156A of the game control core 160. The core cavity 168 further includes a pair of core pin apertures 163 (near side not visible) configured to accept the core pins 158 of the game control core 140. In an embodiment, the core mounting apertures 163 are joined with the lower guide channel 162B.

Assembly Process and Features

The novel features and method of the invention enable as few as a single technician to assemble the gaming machine. Both the monitor subassembly 120 and the game control core 140 are movable via their integrated rollers and can be rolled into position proximal the structural frame 160 to facilitate assembly. In the following paragraphs, an exemplary assembly procedure is described for particular embodiments of the monitor subassembly 120, the game control core 140, and the structural frame 160. Various features of the components are configured to interact with respective features of other components and in all cases are included here for example only and not considered limiting. Features may be modified, repositioned, and even eliminated without violating the spirit and intent of the invention.

With the structural frame 160 in place (for example, on a casino floor), the monitor subassembly 120 may be positioned opposite the open core cavity 168 of the structural frame 160. The monitor subassembly 120 is supported by the roller support system 130 in the free-standing position. The lift coupling 176 of the lift mechanism 170 may be attached to the lift connection 124 and the slack drawn from the belt 174. In this position, the upper and lower guide bearings 126A, 126B are disposed to engage the respective guide channels 162A, 162B as the lift mechanism 170 elevates the monitor subassembly 120 off of the roller support system 130.

Figure 8:
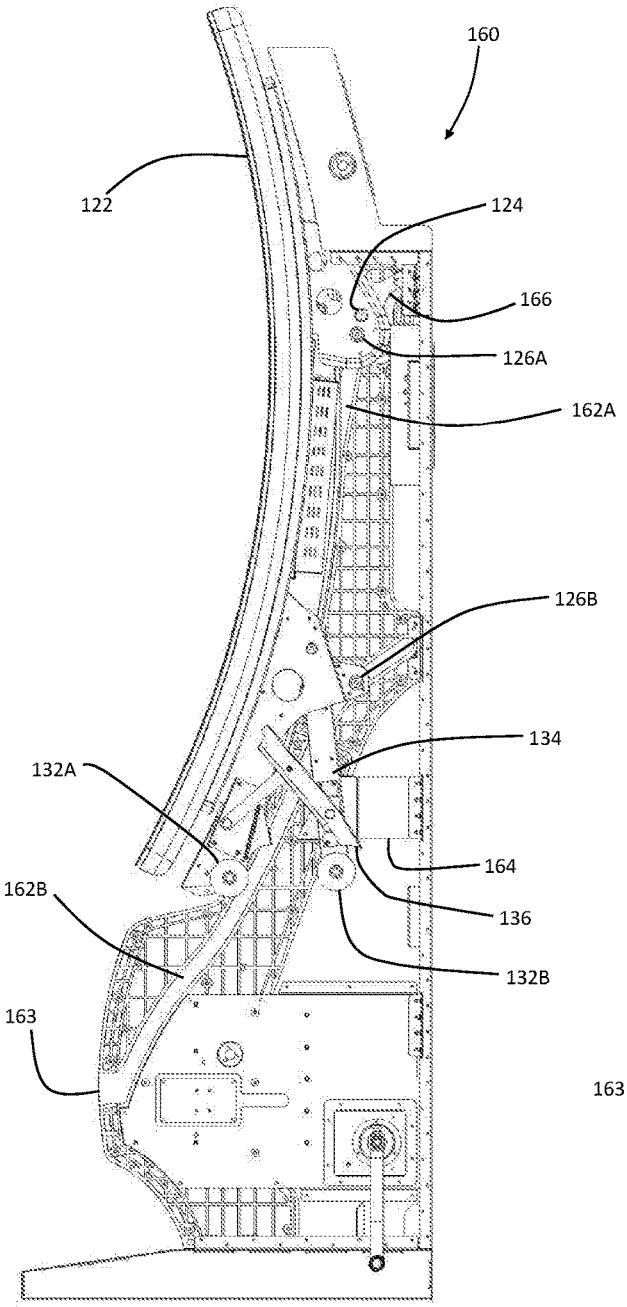
FIG. 8 is a side section view of a structural frame with a monitor subassembly partially lifted to a mounted position.
Figure 9:
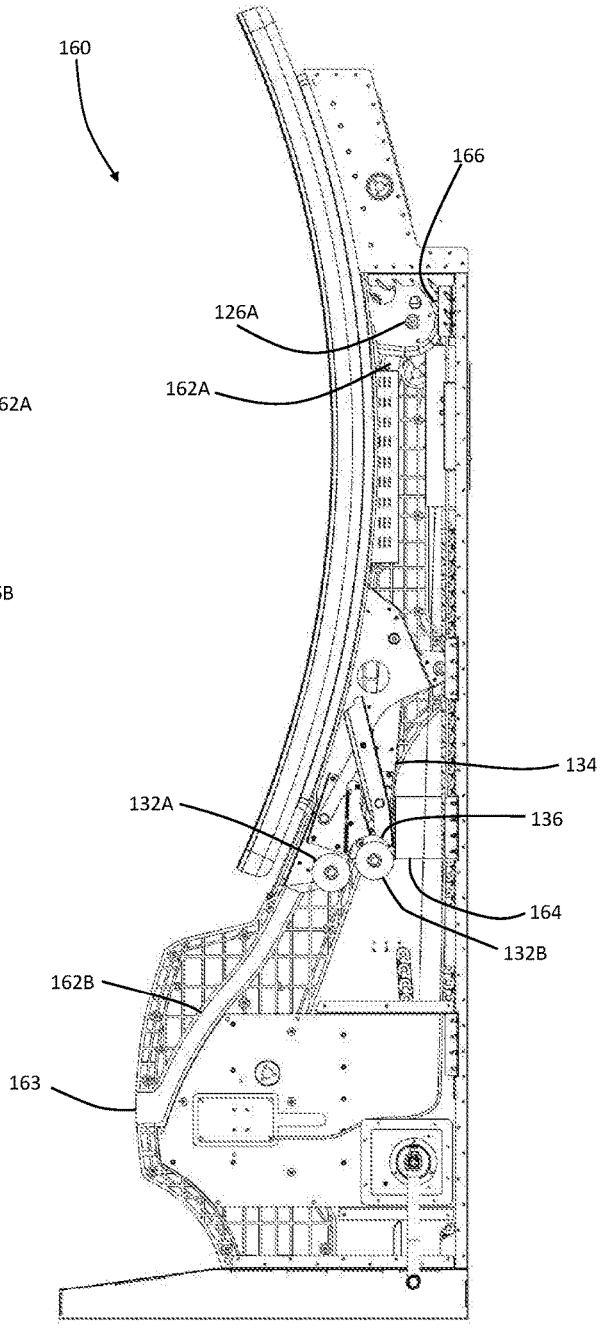
FIG. 9 is a side section view of a structural frame with a monitor subassembly approaching the mounted position.

FIGS. 8 and 9 show a section view of the monitor assembly 120 being lifted from the free-standing position to the mounted position. In FIG. 8, as the monitor subassembly proceeds to rise, steered by its engagement with the guide channels 162A, 162B, the lever 136 of the roller support system contacts the retractor element 164 fixed to the structural frame. As shown in FIG. 9, further elevation of the monitor subassembly causes the lever to retract the pivoting frame 134. The lever and the retractor element remain in contact until the monitor subassembly is lowered towards the free-standing position, maintaining the pivot frame in the retracted position while the monitor subassembly is in the mounted position. In an embodiment, the pivot frame may automatically re-extend when the monitor subassembly is lowered to the free-standing position from the structural frame.

Although not shown clearly in FIG. 8 or 9, as the monitor subassembly approaches the mounted position, the latch hooks 166 automatically engage the lift connection 124 to support the monitor subassembly on the structural frame. Once the latch hooks engage, the lift mechanism may slacken the belt 174 to transfer the weight of the monitor subassembly to the latch hooks. Finally, the monitor subassembly may be fixed to the structural frame using various fasteners.

With the monitor subassembly fixed in the mounted position, the core cavity 168 is exposed below the display device 122 and the game control core 160 may be rolled into a position proximal to the core cavity. The display device may be electrically connected to the electronic components in the game control core for receiving and/or transmitting electronic signals directing the display device to display imager related to the wagering game. In an embodiment that is canted rearwards on the rollers 156A, 156B, pushing down on the input deck 142 lifts the rear rollers 156A to the height of the shelf 161 and the rear portion of the game control core may be inserted into the core cavity above the shelf. Placing the rear rollers on the shelf and the front rollers 156B on the ground substantially levels the input deck and rolling the game control core further into the core cavity may engage the core pins 158 at the front of the core to engage the pin apertures 163 of the structural frame to fully position the game control core in the core cavity. Finally, the game control core may be fixed to the structural frame with various fasteners. The gaming machine 100 is now ready to receive inputs (including monetary value and spin commands) from a player positioned at the input deck in front of the display device, and to initiate and present the wagering game.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A method of assembling a gaming machine, the gaming machine including a monitor subassembly, a structural frame, and a game control core, the monitor subassembly having a free-standing position resting on a plurality of rollers, the structural frame including an integral lift mechanism and a core cavity, the method comprising:

with the monitor subassembly in the free-standing position proximal to the structural frame, connecting the monitor subassembly to the lift mechanism of the structural frame;

lifting the monitor subassembly with the lift mechanism from the free-standing position to a mounted position supported by the structural frame; and after the lifting, inserting at least part of the game control core into the core cavity.

2. The method of claim 1, wherein the game control core includes game-logic circuitry configured to conduct a casino wagering game and to direct an electronic display device of the monitor subassembly to display images associated with the casino wagering game, and further comprising connecting the electronic display device to the game control core for electronic communication therebetween.

3. The method of claim 2, further comprising:

receiving, at the game control core, an input from a player effecting initiation and play of the casino wagering game;

initiating, by the game-logic circuitry, play of the casino wagering game responsive to the wager;

directing, by the game-logic circuitry, the electronic display device to display game images representing a randomly generated outcome; and awarding the player for a winning outcome.

4. The method of claim 1, further comprising fixing the monitor subassembly to the structural frame in the mounted position using one or more fasteners.

5. The method of claim 1, further comprising automatically engaging the monitor subassembly with one or more latches of the structural frame to support the monitor subassembly in the mounted position.

6. The method of claim 1, wherein the plurality of rollers include one or more fixed rollers and one or more retractable rollers, and further comprising automatically retracting the one or more retractable rollers when the monitor subassembly transitions from the free-standing position to the mounted position.

7. The method of claim 6, wherein the one or more retractable rollers are mounted to a pivoting frame, the pivoting frame being pivotable between an extended position and a retracted position, the pivoting frame being biased to the extended position in which the one or more retractable rollers are maximally offset from the one or more fixed rollers, and wherein the automatically retracting includes pivoting the pivoting frame from the extended position to the retracted position.

8. The method of claim 1, wherein the core cavity of the structural frame includes a rear shelf and right and left core pin apertures, wherein the game control core includes right and left core pins, one or more rear castors and one or more vertically offset front castors, and wherein the inserting includes tilting the game control core forward on the one or more front castors, positioning the one or more rear castors on the rear shelf, rolling the at least part of the game control core into the core cavity, and inserting the right and left core pins into the respective right and left core pin apertures.

9. The method of claim 1, wherein the structural frame includes one or more guide channels, wherein the monitor subassembly further includes one or more guide bearings, and wherein the lifting includes guiding the monitor subassembly from the free-standing position to the mounted position via interaction of the one or more guide channels with the respective one or more guide bearings.

10. The method of claim 1, wherein the lift mechanism includes one or more of a winch, a pneumatic device, a hydraulic device, or a mechanical ratchet device, and is manually or electronically controlled.

11. The method of claim 1, wherein the inserted part of the game control core is disposed below the monitor subassembly in the mounted position.

12. A method of assembling a gaming machine, the gaming machine including a monitor subassembly, a structural frame, and a game control core, the monitor subassembly having a free-standing position resting on a plurality of rollers, the structural frame including an integral lift mechanism, the method comprising:

with the monitor subassembly in the free-standing position resting on the plurality of rollers, rolling the monitor subassembly to a position proximal to the structural frame;

after the rolling, connecting the monitor subassembly to the lift mechanism of the structural frame; and lifting the monitor subassembly with the lift mechanism from the free-standing position to a mounted position supported by the structural frame.

13. The method of claim 12, wherein the structural frame includes a core cavity, and further comprising, after the lifting, inserting at least part of the game control core into the core cavity to a position below the monitor subassembly.

14. The method of claim 13, wherein the core cavity of the structural frame includes a rear shelf and right and left core pin apertures, wherein the game control core includes right and left core pins, one or more rear castors and one or more vertically offset front castors, and wherein the inserting includes tilting the game control core forward on the one or more front castors, positioning the one or more rear castors on the rear shelf, rolling the at least part of the game control core into the core cavity, and inserting the right and left core pins into the respective right and left core pin apertures.

15. The method of claim 13, wherein the game control core includes game-logic circuitry configured to conduct a casino wagering game and to direct an electronic display device of the monitor subassembly to display images associated with the casino wagering game, and further comprising connecting the electronic display device to the game control core for electronic communication therebetween.

16. The method of claim 15, further comprising:

receiving, at the game control core, an input from a player effecting initiation and play of the casino wagering game;

initiating, by the game-logic circuitry, play of the casino wagering game responsive to the wager;

directing, by the game-logic circuitry, the electronic display device to display game images representing a randomly generated outcome; and awarding the player for a winning outcome.

17. The method of claim 12, further comprising fixing the monitor subassembly to the structural frame in the mounted position using one or more fasteners.

18. The method of claim 12, further comprising automatically engaging the monitor subassembly with one or more latches of the structural frame to support the monitor subassembly in the mounted position.

19. The method of claim 12, wherein the plurality of rollers includes a retractable roller movable between an extended position and a retracted position, the retractable roller being in the extended position when the monitor subassembly is in the free-standing position resting on the plurality of rollers, and further comprising retracting the retractable roller from the extended position to the retracted position when the monitor subassembly transitions from the free-standing position to the mounted position.

20. The method of claim 12, wherein the structural frame includes one or more guide channels, wherein the monitor subassembly further includes one or more guide bearings, and wherein the lifting includes guiding the monitor subassembly from the free-standing position to the mounted position via interaction of the one or more guide channels with the respective one or more guide bearings.

* * * * *